252-99 AU 165 EX
8/10/76 XR 3,974,082

United States Patent [19]
Weyn

[11] 3,974,082
[45] Aug. 10, 1976

[54] BLEACHING COMPOSITIONS

[75] Inventor: Hendrik Frans Weyn, Le Chesnay, France

[73] Assignee: Colgate-Palmolive Company, New York, N.Y.

[22] Filed: Oct. 4, 1974

[21] Appl. No.: 512,071

Related U.S. Application Data

[63] Continuation of Ser. No. 282,367, Aug. 21, 1972, abandoned.

[52] U.S. Cl. ..... 252/95; 8/111; 252/99

[51] Int. Cl.[2] ..... C11D 3/395; C11D 7/54

[58] Field of Search ..... 252/95, 99, 186; 8/111

[56] References Cited

UNITED STATES PATENTS

| | | | |
|---|---|---|---|
| 2,955,905 | 10/1960 | Davies et al. | 8/111 |
| 3,637,339 | 1/1972 | Gray | 8/111 |

*Primary Examiner*—Mayer Weinblatt
*Attorney, Agent, or Firm*—Murray M. Grill; Norman Blumenkopf; Herbert S. Sylvester

[57] ABSTRACT

A bleaching composition and method utilizing a percompound, an acyl-alkyl ester, and an ester-hydrolyzing enzyme, the ester and the enzyme being adapted to react to form an activator for the percompound.

7 Claims, No Drawings

BLEACHING COMPOSITIONS

This is a continuation of application Ser. No. 282,367, filed Aug. 21, 1972, now abandoned.

The invention here presented is broadly in the field of bleaching; more particularly it relates to activators for oxygen-releasing compounds and relates especially to activators formed from peracid precursors.

The use of per-compounds which liberate hydrogen peroxide such as inorganic perhydrates, which, when dissolved liberate hydrogen peroxide enclosed in their crystal lattice (e.g., perborates, perphosphates, persilicates) and peroxides which yield hydrogen peroxide by hydrolysis (e.g., sodium peroxide or certain percarbonates) in domestic or industrial laundering is well known. There are, in particular, detergent compositions in which per-compounds such as sodium perborate frequently comprises between 1 and 35% of the total composition.

Hydrogen peroxide and the precursors which liberate it in solution are good oxidizing agents for removing certain stains from cloth, especially stains caused by wine, tea, coffee, cocoa, fruits, etc. However, hydrogen peroxide and its percursors have been found to bleach quickly and most effectively only at a relatively high temperature, e.g., about 80° to 100°C. Since it is often impracticable or inconvenient to boil the wash water the full potential of oxygen bleaches has not yet been realized because of their poor bleaching at temperatures below 80°C. Since these bleaches are relatively safe both in concentrated form and on colors, and since they can be formulated directly in the detergent, it is desirable to provide a process for bleaching with peroxygen compounds and compositions containing them, which provide effective bleaching and stain removing properties at temperatures below boiling, e.g., 25° – 80°C.

Most bleaching is done in an alkaline medium. It is believed, without being limited to any theory, that hydrogen peroxide ionizes in an alkaline medium into a hydrogen ion and a negatively charged perhydroxyl ion. The perhydroxyl ion can react with additional hydrogen peroxide to yield active oxygen which is also negatively charged. Both the perhydroxyl ion and the active oxygen ion can bleach by oxidizing a substrate via electron transfer. Since materials to be bleached are usually negatively charged, the material and the perhydroxyl ion or active oxygen mutually repel each other and it takes high temperatures before the perhydroxyl ion or active oxygen has sufficient energy to overcome this repulsion. An activator which has a higher oxidation potential then the per-compound alone would result in improved bleaching at lower temperatures.

It is known that peracids which are formed from hydrogen peroxide and an acid are stronger oxidizing agents than hydrogen peroxide itself. However, peracids are relatively unstable and cannot be used as such but only formed in-situ from a peroxygen compound such as sodium perborate and a suitable peracid precursor.

The present invention relates to a process and composition for forming peracids in-situ in order to obtain significant bleaching effects at temperatures of about 25° – 80°C., preferably about 50° – 70°C. Broadly then, the invention relates to the process for bleaching materials at temperatures below boiling, e.g., about 25° – 80°C., in aqueous solution which comprises reacting a per-compound of the oxygen-releasing type, an acyl-alkyl ester wherein the acyl group has 2 to 8 carbon atoms and an ester-hydrolyzing enzyme which in aqueous media liberates said acyl moiety from said ester.

The invention also relates to a bleaching composition comprising a per-compound of the oxygen-releasing type, an acyl-alkyl ester having an acyl group of 2 to 8 carbon atoms and an alkyl group of 1 to 10 carbon atoms and an ester-hydrolyzing enzyme which releases said acyl moiety.

In the present invention, the ester and ester-hydrolyzing enzyme are precursors in the formation of peracids in-situ, i.e., in bleaching solution. The reactive carboxylic group formed reacts with the per-compound to form peracids which have the requisite bleaching effects at temperatures of about 25° – 80°C.

Per-compounds which are oxygen-releasing and employable in the present invention are hydrogen peroxide, alkali metal peroxides such as sodium perborate and potassium perborate, alkali metal perphosphates such as sodium perphosphate and potassium perphosphate, alkali metal persilicates, such as sodium persilicate and potassium persilicate, and alkali metal percarbonates such as sodium percarbonate and potassium percarbonate.

The per-compounds are generally present in the ratio by weight of per-compound to ester-substrate of about 1.0 to 6.0 to about 6.0 to 1.0; the preferred ratios being about ½ to 3 to about 2 to 1. The per-compounds are typically present in bleaching compositions in amount of about 1.0 to about 40% by weight, preferably 3 to 20% and more preferably 5 to 15% by weight of the total composition.

Generally, the esters employable in the present invention are acyl-alkyl esters having the general formula:

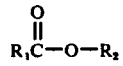

wherein $R_1$ is part of the organic moiety making up the acyl portion of the ester and has 1 to 7 carbon atoms in its chain and $R_2$ is the alkyl moiety of the ester and has 1 to 10 carbon atoms in its chain. Examples of preferred acyl-alkyl esters are esters of acetic acid such as methyl acetate, ethyl-acetate, propyl acetate, isopropyl acetate and acetals having the formula

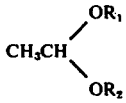

wherein $R_1$ and $R_2$ are radicals having 2 to 8 carbon atoms in their chain, and other aliphatic esters such as methylbutyrate, ethyl butyrate, propyl butyrate, and isopropyl butyrate.

The amount by weight of ester employable in the bleaching process and composition is dependent upon the amount of per-compound present.

The ester hydrolyzing enzymes are usually specific for the simple aliphatic esters employable in this invention. Generally, the ester hydrolyzing enzymes this invention makes use of are esterases and lipases. Examples of preferred esterases are acetylesterase and carboxylesterase. These esterases hydrolyze carboxylic esters and have wide distribution in mammalian tissues, insects, plants, citrus fruits and fungi. A preferred preparation is from horse liver [Connors, W. M., Pihl, A., Dounce, A. L. & Stotz, E. (1950), J. biol. Chem. 184, 29; Burch, 1954], with a specific activity of 0.25 m-mole of ethyl butyrate/mg. protein N/min.

Examples of preferred lipases are plant lipases, pancreatic lipase and gastric lipase. These lipases also hydrolyze carboxylic esters and are present in mammalian pancreas and oats. A preferred preparation is from pig pancreas [Sarda, L., Marchis-Mouren, G., Constantin, M. J. & Desnuell, P. (1957), Biochim. biophys. Acta, 23, 264], with a specific activity of 63 m-moles of olive oil/mg. protein N/min.

The amount of enzyme employed depends upon the amount of ester-substrate present. The ratio of ester to enzyme is about 30 to 1 to about 5 to 1 and preferably about 20 to 1 to about 10 to 1. The amounts of enzyme required also varies with the specific activity of the enzyme employed. With regard to the recited ratio, it is assumed that the specific activity of the enzyme employed is of the order of magnitude set out above.

The invention also relates to the instant bleaching processes carried out in the presence of compositions containing organic detergent selected from the group consisting of water-soluble soap, and synthetic organic detergents.

Examples of suitable water-soluble soaps include the water-soluble salts, e.g., the sodium, ammonium, and alkylolammonium salts, of higher fatty acids or resin salts containing about 8 to 20 carbon atoms, preferably 10 to 18 carbon atoms. Suitable fatty acids can be obtained from oils and waxes of animal or vegetable origin, e.g., tallow, grease, coconut oil, tall oil and mixtures thereof. Particularly useful are the sodium and potassium salts of the fatty acid mixtures derived from coconut oil and tallow, e.g., sodium coconut soap and potassium tallow soap.

Synthetic organic detergents employable in the present invention comprise detergents selected from the group consisting of anionic, nonionic, amphoteric, and zwitterionic detergents.

Anionic synthetic detergents include those surface active or detergent compounds which contain an organic hydrophobic group containing generally 8 to 26 carbon atoms and preferably 10 to 18 carbon atoms in their molecular structure, and at least one water-solubilizing group selected from the group of sulfonate, sulfate, carboxylate, phosphonate and phosphate so as to form a water-soluble synthetic detergent.

The anionic class of detergents also include the water-soluble sulfated and sulfonated synthetic detergents having an alkyl radical of 8 to 26, and preferably about 12 to 22 carbon atoms, in their molecular structure. (The term alkyl includes the alkyl portion of the higher acyl radicals.)

Examples of the sulfonated anionic detergents are the higher alkyl mononuclear aromatic sulfonates such as the higher alkyl benzene sulfonates containing from 10 to 16 carbon atoms in the higher alkyl group in a straight or branched chain, e.g., the sodium, potassium and ammonium salts of higher alkyl benzene sulfonates, higher alkyl toluene sulfonates, higher alkyl phenol sulfonates, and higher naphthalene sulfonates. A preferred sulfonate is linear alkyl benzene sulfonate having a high content of 3- (or higher) phenyl isomers and a correspondingly low content (well below 50 percent) of 2- (or lower) phenyl isomers, i.e., wherein the benzene ring is preferably attached in large part at the 3 or higher (e.g., 4, 5, 6 or 7) position of the alkyl group and the content of isomers in which the benzene ring is attached at the 2 or 1 position is correspondingly low. Particularly preferred materials are set forth in U.S. Pat. No. 3,320,174.

Other suitable anionic detergents are the olefin sulfonates, including long-chain alkene sulfonates, long-chain hydroxyalkane sulfonates or mixtures of alkene-sulfonates and hydroxyalkane-sulfonates. These olefin sulfonate detergents may be prepared in a known manner by the reaction of $SO_3$ with long-chain olefins containing 8 to 25, preferably 12 to 21, carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkenesulfonic acids which is then treated to convert the sultones to sulfonates. Other examples of sulfate or sulfonate detergents are paraffin sulfonates containing about 10 to 20, preferably about 15 to 20 carbon atoms, e.g., the primary paraffin sulfonates made by reacting long-chain alpha olefins and bisulfites and paraffin sulfonates having the sulfonate groups distributed along the paraffin chain as shown in U.S. Pat. Nos. 2,503,280; 2,507,088; 3,260,741; 3,372,188 and German Pat. No. 735,096; sodium and potassium sulfates of higher alcohols containing 8 to 18 carbon atoms such as sodium lauryl sulfate and sodium tallow alcohol sulfate; sodium and potassium salts of α-sulfo-fatty acid esters containing about 10 to 20 carbon atoms in the acyl group, e.g., methyl α-sulfomyristate and methyl α-sulfotallowate, ammonium sulfates of mono- or diglycerides of higher ($C_{10}$–$C_{18}$) fatty acids, e.g., stearic monoglyceride monosulfate; sodium and alkylolammonium salts of alkyl polyethenoxy ether sulfates produced by condensing 1 to 5 moles of ethylene oxide with one mole of higher ($C_8$–$C_{18}$) alcohol; sodium higher alkyl ($C_{10}$–$C_{18}$) glyceryl ether sulfonates; and sodium or potassium alkyl phenol polyethenoxy ether sulfates with about 1 to 6 oxyethylene groups per molecule and in which the alkyl radicals contain about 8 to about 12 carbon atoms.

The suitable anionic detergents include also the $C_8$–$C_{18}$ acyl sarcosinates (e.g., sodium lauroyl sarcosinate), sodium and potassium salts of the reaction product of higher fatty acids containing 8 to 18 carbon atoms in the molecule esterified with isethionic acid, and sodium and potassium salts of the $C_8$–$C_{18}$ acyl N-methyl taurides, e.g., sodium cocoyl methyl taurate and potassium stearoyl methyl taurate.

Anionic phosphate surfactants in which the anionic solubilizing group attached to the hydrophobic group is an oxyacid of phosphorous are also useful in the detergent compositions. Suitable phosphate surfactants are the sodium, potassium and ammonium alkyl phosphate esters such as $(R{-}O)_2PO_2M$ and $ROPO_3M_2$ in which R represents an alkyl chain containing from about 8 to about 20 carbon atoms or an alkyl phenyl group having 8 to 20 carbon atoms and M represents a soluble cation. The compounds formed by including about one to 40 moles of ethylene oxide in the foregoing esters, e.g., $[R{-}O(EtO)n]_2PO_2M$, are also satisfactory.

The particular anionic detergent salt will be suitably selected depending upon the particular formulation and the proportions therein. Suitable salts include the ammonium, substituted ammonium (mono-, di- and triethanolammonium), alkali metal (such as sodium and potassium) and alkaline earth metal (such as calcium and magnesium) salts. Preferred salts are the ammonium, triethanolammonium, sodium and potassium salts of the higher alkyl sulfates and the $C_8$–$C_{18}$ acyl sarcosinates.

The nonionic synthetic organic detergents are generally the condensation product of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a nonionic detergent. Further, the length of the polyethenoxy chain can be adjusted to achieve the desired balance between the hydrophobic and hydrophilic elements.

The nonionic detergents include the polyethylene oxide condensate of one mole of alkyl phenol containing from about 6 to 12 carbon atoms in a straight- or branched-chain configuration with about 5 to 30 moles of ethylene oxide, e.g., nonyl phenol condensed with 9 moles of ethylene oxide, dodecyl phenol condensed with 15 moles of ethylene oxide and dinonyl phenol condensed with 15 moles of ethylene oxide. Condensation products of the corresponding alkyl thiophenols with 5 to 30 moles of ethylene oxide are also suitable.

Still other suitable nonionics are the polyoxyethylene polyoxypropylene adducts of 1-butanol. The hydrophobe of these nonionics has a minimum molecular weight of 1,000 and consists of an aliphatic monohydric alcohol containing from 1 to 8 carbon atoms to which is attached a heteric chain of oxyethylene and oxypropylene. The weight ratio of oxypropylene to oxyethylene covers the range of 95:5 to 85:15. Attached to this is the hydrophilic polyoxyethylene chain which is from 44.4 to 54.6 percent of the total molecular weight of 1,400 to 4,000.

Also included in the nonionic detergent class are the condensation products of a higher alcohol containing about 8 to 18 carbon atoms in a straight- or branched-chain configuration condensed with about 5 to 30 moles of ethylene oxide, e.g., lauryl-myristyl alcohol condensed with about 16 moles of ethylene oxide.

A particularly useful group of nonionics is marketed under the trade name "Pluronics". The compounds are formed by condensing ethylene oxide with a hydrophobic base formed by the condensation of propylene oxide with propylene glycol. The molecular weight of the hydrophobic portion of the molecule is of the order of 950 to 4,000, preferably 1200 to 2500. The addition of polyoxyethylene radicals to the hydrophobic portion tends to increase the solubility of the molecule as a whole. The molecular weight of the block copolymers varies from 1100 to 15,000 and the polyethylene oxide content may comprise 20 to 80 percent by weight.

Other suitable nonionics may be derived by the condensation of ethylene oxide with the product resulting from the reaction of propylene oxide and ethylene diamine. The molecular weight varies from 500 to 4,500.

Other nonionic detergents include the ethylene oxide addends of monoesters of hexahydric alcohols and inner ethers thereof with higher fatty acids containing about 10 to 20 carbon atoms, e.g., sorbitan monolaurate, sorbitan mono-oleate, and mannitan monopalmitate.

The amphoteric detergents which can be used in the compositions of this invention are generally water-soluble salts of derivatives of aliphatic amines which contain at least one cationic group, e.g., non-quaternary nitrogen, quaternary ammonium, or quaternary phosphonium group, at least one alkyl group of about 8 to 18 carbon atoms and an anionic water-solubilizing carboxyl, sulfo, sulfato, phosphato or phosphono group in their molecular structure. The alkyl group may be straight chain or branched and the specific cationic atom may be part of a heterocyclic ring.

Examples of suitable ampholytic detergents include the alkyl beta-aminopropionates, $RN(H)C_2H_4COOM$; the alkyl betaaminodipropionates, $RN(C_2H_4COOM)_2$; the alkyl and hydroxy alkyl taurinates, $RN(CH_3)C_2H_4SO_3M$; and the long-chain imidazole derivatives having the following formulas:

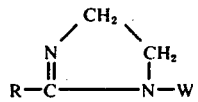

(I)

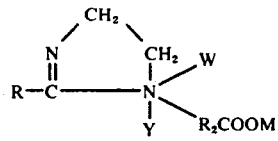

(II)

wherein R is an acyclic group of about 7 to 17 carbon atoms; W is selected from the group of ROH, $R_2COOM$, and $R_2OR_2COOM$; Y is selected from the group consisting of $OH^-$, $R_3OSO_3^-$; $R_2$ is an alkylene or hydroxyalkylene group containing 1 to 4 carbon atoms, R is selected from the group consisting of alkyl, alkyl aryl and fatty acyl glyceride groups having 6 to 18 carbon atoms in the alkyl or an acyl group; and M is a water-soluble cation, e.g., sodium, potassium, ammonium or alkylolammonium.

Formula I detergents are disclosed in Volume II of "Surface Active Agents and Detergents" and in French Patent No. 1,412,921 and Formula II detergents are described in U.S. Pat. Nos. 2,773,068; 2,781,354; and 2,781,357. The acyclic groups may be derived from coconut oil fatty acids (a mixture of fatty acids containing 8 to 18 carbon atoms), lauric fatty acid, and oleic fatty acid and the preferred groups are $C_7$–$C_{17}$ alkyl groups. Preferred detergents are sodium N-lauryl beta-aminopropionate, disodium N-lauryl iminodipropionate, and the disodium salt of 2-lauryl-cycloimidium-1-hydroxyl, 1-ethoxyethanoic acid, 1-ethanoic acid.

Zwitterionic detergents such as the betaines and sulfo-betaines having the following formula are also useful;

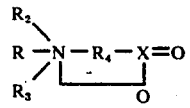

wherein R is an alkyl group containing about 10 to 18 carbon atoms; $R_2$ and $R_3$ are each $C_1$–$C_3$ alkyl; $R_4$ is an alkylene or hydroxyalkylene group containing about 1 to 4 carbon atoms; and X is C or S:O. The alkyl group can contain one or more intermediate linkages such as amido, ether or polyether linkages or non-functional substituents such as hydroxyl or halogen which do not substantially affect the hydrophobic character of the group. When X is C, the detergent is called a betaine; and when X is S:O, the detergent is called a sulfobetaine or sultaine. Preferred betaine and sulfobetaine detergents are 1-(lauryl dimethylammonio) acetate, 1-(myristyldimethylammonio) propane-3-sulfonate, and 1-(myristyldimethylammonio)-2-hydroxypropane-3-sulfonate.

The polar nonionic detergents are those in which the hydrophilic group contains a semi-polar bond directly between two atoms, for example, $N \rightarrow O$; $P \rightarrow O$, $As \rightarrow O$, and $S \rightarrow O$. There is charge separation between the two directly bonded atoms, but the detergent molecule bears no net charge and does not dissociate into ions.

The polar nonionic detergents of this invention include open-chain aliphatic amine oxides of the general formula $R_1R_2R_3N \rightarrow O$. For the purposes of this invention $R_1$ is an alkyl, alkenyl, or monohydroxyalkyl radical having about 10 to 16 carbon atoms. $R_2$ and $R_3$ are each selected from the group consisting of methyl, ethyl, propyl, ethanol, and propanol radicals.

Other operable polar nonionic detergents are the open-chain aliphatic phosphine oxides having the general formula $R_1R_2R_3P \rightarrow O$ wherein $R_1$ is an alkyl, alkenyl, or monohydroxyalkyl radical ranging in chain length from 10 to 18 carbon atoms, and $R_2$ and $R_3$ are each alkyl and monohydroxyalkyl radicals containing from 1 to 3 carbon atoms.

Cationic surface active agents may also be employed. Such agents are those surface active detergent compounds which contain an organic hydrophobic group and a cationic solubilizing group. Typical cationic solubilizing groups are amine and quaternary groups.

Examples of suitable synthetic cationic detergents are normal primary amines $RNH_2$ wherein R is $C_{12}$–$C_{15}$; the diamines such as those of the type $RNHC_2H_4NH_2$ wherein R is an alkyl group of about 12 to 22 carbon atoms, such as N-2-aminoethyl stearyl amine and N-2-amino ethyl myristyl amine; amide-linked amines such as those of the type $R_1CONHC_2H_4NH$ wherein $R_1$ is an alkyl group of about 8 to 20 carbon atoms, such as N-2-amino ethylstearyl amide and N-amino ethylmyristyl amide; quaternary ammonium compounds wherein typically one of the groups linked to the nitrogen atom is an alkyl group of about 8 to 22 carbon atoms and three of the groups linked to the nitrogen atom are alkyl groups which contain 1 to 3 carbon atoms, including alkyl groups bearing inert substituents, such as phenyl groups, and there is present an anion such as halogen, acetate, methosulfate, etc. The alkyl group may contain intermediate linkages such as amido which do not substantially affect the hydrophobic character of the group, e.g., stearyl amido propyl quaternary ammonium chloride. Typical quaternary ammonium detergents are ethyl-dimethyl-stearyl ammonium chloride, benzyl-dimethyl-stearyl ammonium chloride, trimethylstearyl ammonium chloride, trimethyl-cetyl ammonium bromide, dimethyl-ethyl-lauryl ammonium chloride, dimethyl-propyl-myristyl ammonium chloride and the corresponding methosulfates and acetates.

The water-soluble soaps and synthetic organic detergents set forth above, when employed in the inventive compositions usually are present in amounts ranging from 4 to 40% and preferably 15 to 35% by weight of the total composition.

The compositions can also contain conventional ingredients such as builder salts. Suitable representatives include the following: trisodium phosphate, tetrasodium pyrophosphate, sodium acid pyrophosphate, sodium tripolyphosphate, sodium monobasic phosphate, sodium dibasic phosphate, sodium hexamethaphosphate, sodium metasilicate, sodium silicates ($Na_2O/SiO_2$ of 1/1.6 to 1/3.2), sodium carbonate, sodium sulfate, borax, ethylene diamine tetraacetic acid tetrasodium salts, trisodium nitrilotriacetate, citrates, e.g., sodium citrate, citric acid, glycollates, e.g., sodium glycollate, phosphonates, diphosphonates, organic polyelectrolytes, e.g., vinyl methyl ethermaleic anhydride interpolymers and water-soluble salts thereof (alkali metal, ammonium, amine, etc.); polymaleic anhydride and water-soluble salts (sodium, potassium, ammonium, etc.) and mixtures thereof.

Usually substantial amounts of compatible "builder" materials will be present in the invential compositions, the amounts being in order of about 40 to 90% by weight, preferably about 65 to 85% by weight of the composition. The compositions may also contain other conventional ingredients, for example, anti-deposition agents such as sodium carboxymethyl cellulose; suds builders such as ammonia amides N-alkyl amides, and alkanolamides of fatty acids (e.g., coconut monoethanolamide and lauroyl and myristoyl glycerol amides, ethanol amides and isopropanol amides); optical bleaching agents; color; and perfume.

The following examples further illustrate this invention:

EXAMPLE 1

| | Percent by Weight |
|---|---|
| Sodium linear tridecyl benzene sulfonate | 35.0 |
| Anhydrous pentasodium tripolyphosphate | 40.0 |
| Sodium perborate | 8.0 |
| Ethylbutyrate | 8.0 |
| Acetylesterase | 0.8 |
| Perfume | 0.5 |
| Moisture and Additives such as brightner, color, etc. | 7.7 |
| | 100.0 |

EXAMPLE 2

| | Percent by Weight |
|---|---|
| Sodium tetrapropyl-benzene sulfonate | 12.0 |
| Sodium carbonate | 35.0 |
| Potassium persilicate | 30.0 |
| Propyl acetate | 10.0 |
| Carboxylesterase | 0.5 |
| Perfume | 0.5 |
| Moisture and Additives such as brightners, color, etc. | 2.0 |
| | 100.0 |

EXAMPLE 3

| | Percent by Weight |
|---|---|
| Sodium dodecylbenzene sulfonate | 18.0 |
| Sodium tripolyphosphate | 35.0 |
| Monoethanolamide of coconut oil fatty acid | 2.5 |
| Sodium silicate | 7.0 |
| Sodium sulfate | 9.0 |
| Magnesium silicate | 1.0 |
| Sodium perborate | 5.0 |
| Ethyl acetate | 10.0 |
| Pancreatic lipase | 0.5 |
| Perfume | 1.0 |
| Moisture and Additives such as brightner, color, etc. | 11.0 |
| | 100.0 |

A washing solution is prepared by dissolving 12.5 grams or 5 grams per liter of any of the compositions recited in Examples 1 to 3 in tap water having a hardness of 50 ppm. Soiled household laundry is immersed in the washing solution for 10 minutes at about 50°C. and stirred after which the laundry is removed, rinsed in water and dried. The bleaching effects are observed. Broadly, the improved process for bleaching comprises contacting the fabric or textile material to be bleached with an aqueous washing solution containing effective amounts of an oxygen-releasing per-compound, an acyl-alkyl ester and an ester hydrolyzing enzyme at temperatures ranging from about 25° to 80°C. from 1 up to about 30 minutes and preferably at about 50°C. for 5 to 15 minutes. The material to be treated may be pre-soaked or allowed to stand in the aqueous washing solution or the solution containing the material may be stirred or agitated.

It is to be understood that the invention is not limited to the specific embodiments described above. Various modifications can be made in the process and in the compositions without departing from the spirit or scope of the invention.

What is claimed is:

1. A process for bleaching materials which comprises contacting the material to be bleached with an aqueous solution, said solution being at a temperature of at least 25°C. and containing effective amounts of an oxygen-releasing inorganic percompound, an acyl-alkyl ester having the formula $R_1COOR_2$ wherein $R_1$ is an alkyl group of 1 to 7 carbon atoms and $R_2$ is an alkyl group of 1 to 10 carbon atoms and an esterase or lipase enzyme capable of hydrolyzing said ester wherein the ratio of said percompound to said ester is about 1 to 6 to about 6 to 1 and the ratio of said ester to said enzyme is about 30 to 1 to about 5 to 1, and said percompound is present in an amount of about 1% to about 40% by weight of the total composition.

2. A process according to claim 1 wherein said percompound is selected from the group consisting of hydrogen peroxide, alkali metal peroxides, perborates, perphosphates, persilicates, and percarbonates.

3. A process according to claim 1 wherein also present in the aqueous solution is about 4 to 40% of a detergent selected from the group consisting of water soluble soap and synthetic organic detergent and mixtures thereof.

4. A bleaching composition consisting essentially of an oxygen-releasing inorganic percompound, an acyl-alkyl ester having the formula $R_1COOR_2$ wherein $R_1$ is an alkyl group of 1 to 7 carbon atoms and $R_2$ is an alkyl group of 1 to 10 carbon atoms and an esterase or lipase enzyme capable of hydrolyzing said ester, said composition being effective for bleaching at temperatures of 25°C. and above, wherein said percompound is present in an amount of about 1% to about 40% by weight of the total composition, and wherein the ratio of said percompound to said ester is about 1 to 6 to about 6 to 1 and the ratio of said ester to said enzyme is about 30 to 1 to about 5 to 1.

5. A bleaching composition according to claim 4 wherein also present is about 4 to 40% by weight of an organic detergent selected from the group consisting of water soluble soap and organic synthetic detergent and mixtures thereof.

6. A bleaching composition according to claim 4 wherein said percompound is selected from the group consisting of hydrogen peroxide, alkali metal peroxides, perborates, perphosphates, persilicates, and percarbonates.

7. A bleaching composition according to claim 4 wherein said esterase is selected from the group consisting of acetylesterase and carboxylesterase and said lipase is selected from the group consisting of plant lipases, pancreatic lipase and gastric lipase.

* * * * *